US005462267A

United States Patent [19]

Hori

[11] Patent Number: 5,462,267

[45] Date of Patent: Oct. 31, 1995

[54] FEEDING DEVICE

[75] Inventor: Haruhiko Hori, Toyokawa, Japan

[73] Assignee: Minolta Co., Ltd., Osaka, Japan

[21] Appl. No.: 163,660

[22] Filed: Dec. 6, 1993

[30] Foreign Application Priority Data

Dec. 7, 1992 [JP] Japan ..... 4-326528

[51] Int. Cl.[6] ..... B65H 5/00

[52] U.S. Cl. ..... 271/10.04; 271/110; 271/111; 271/116; 271/118

[58] Field of Search ..... 271/118, 111, 271/114, 116, 117

[56] References Cited

U.S. PATENT DOCUMENTS 4,097,041 6/1978 Fujimoto ..... 271/114
4,927,130 5/1990 Tanaka et al. ..... 271/114 X

FOREIGN PATENT DOCUMENTS 57-199744 5/1981 Japan .
0051521 3/1987 Japan ..... 271/117
3216428 9/1991 Japan ..... 271/110

OTHER PUBLICATIONS

Groenewald, Picker Document and Separator, 1–72, IBM Techical Disclosure Bulletin vol. 14 No. 8 pp. 2265–2266.
Thigpen, Rotating Arm for Picker Roller, 8–76, IBM Technical Disclosure Bulletin vol. 19 No. 3 pp. 752–753.

*Primary Examiner*—H. Grant Skaggs
*Assistant Examiner*—Carol L. Druzbick
*Attorney, Agent, or Firm*—Price, Gess & Ubell

[57] ABSTRACT

A feeding device having a pickup roller which makes pressure contact with paper to feed the paper, a forward rotation roller which is disposed downstream from the pickup roller relative to a paper feeding direction and rotated faster than the pickup roller and a reverse rotation roller which makes pressure contact with the forward rotation roller. One way clutch is disposed between the pickup roller and a drive shaft thereof so as to enable to rotate the pickup roller following the paper transported by the forward rotation roller. The pressure contact force of the pickup roller relative to the paper is reduced when the pickup roller is rotated following the sheet transported by the forward rotation roller.

9 Claims, 5 Drawing Sheets

S1
S2
S3
S4
S5
S6
S7
ON
OFF
OFF
ON
OFF
Vp
Vf
V'p
VOLTAGE
CLUTCH 15
DETECTED PULSE
SOLENOID 11
TIME

FEEDING DEVICE

BACKGROUND OF THE INVENTION

1. Field of the Invention

The present invention relates to a feeding device for copiers, printers and the like.

2. Description of the Related Art

Conventional feeding devices for copiers and printer and the like have pick-up rollers for feeding the paper sheets and a handling section for handling the paper sheets disposed downstream from said pickup roller in the sheet transport direction. The handling section is known to be provided with a forward rotation roller that is rotatably driven in the same direction as the sheet transport direction, and a reverse rotation roller that is rotatably driven in the opposite direction to the sheet transport direction and which is in pressure contact with said forward rotation roller. The aforesaid handling section is constructed such that when the pickup roller feeds a plurality of sheets to the nip area between the forward rotation roller and the reverse rotation roller, only the uppermost sheet is fed thereto while a second and any subsequent sheets are returned by the reverse rotation roller. Typically, the sheet transport speed of the forward rotation roller is set so as to be greater than the sheet transport speed of the pickup roller.

In a feeding device of the aforesaid construction, a sensor for detecting the fed sheets is provided near the nip area of the forward rotation roller and the reverse rotation roller, such that when the insertion of a sheet into the nip area is detected, the pickup roller separates from said sheet. Thus, the pickup roller prevents deterioration caused by the friction generated between said roller and the sheet transported at the sheet transport speed by the forward rotation roller by means of the separation of said pickup roller from the sheet.

In a conventional feeding device such as described above, there is some anxiety that the pickup roller will separate from the sheet before said sheet is reliably inserted in the nip area formed by the forward rotation roller and the reverse rotation roller. When the pickup roller separates from a sheet before said sheet is reliably inserted in the aforesaid nip area, the sheet does not receive sufficient transport force from the pickup roller which results in improper feeding of the sheet.

SUMMARY OF THE INVENTION

A main object of the present invention is to provide a feeding device capable of reliably feeding paper.

A further object of the present invention is to provide a feeding device capable of preventing improper paper feeding.

A still further object of the present invention is to provide a feeding device capable of preventing deterioration of the pickup roller.

These and other objects of the invention are achieved by providing a feed roller which makes pressure contact with paper and feeds the paper, a drive shaft for driving the feed roller, a transporting roller disposed downstream from the feed roller relative to a paper feeding direction for transporting the paper fed by the feed roller, a oneway clutch disposed between the drive shaft and the feed roller so as to rotate the feed roller following the paper transported by the transporting roller and switching means for reducing the pressure contact force of the feed roller relative to the paper when the feed roller is rotated following the sheet transported by the transporting roller.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiments of the present invention are described hereinafter with reference to the accompanying drawings.

Figure 1A:
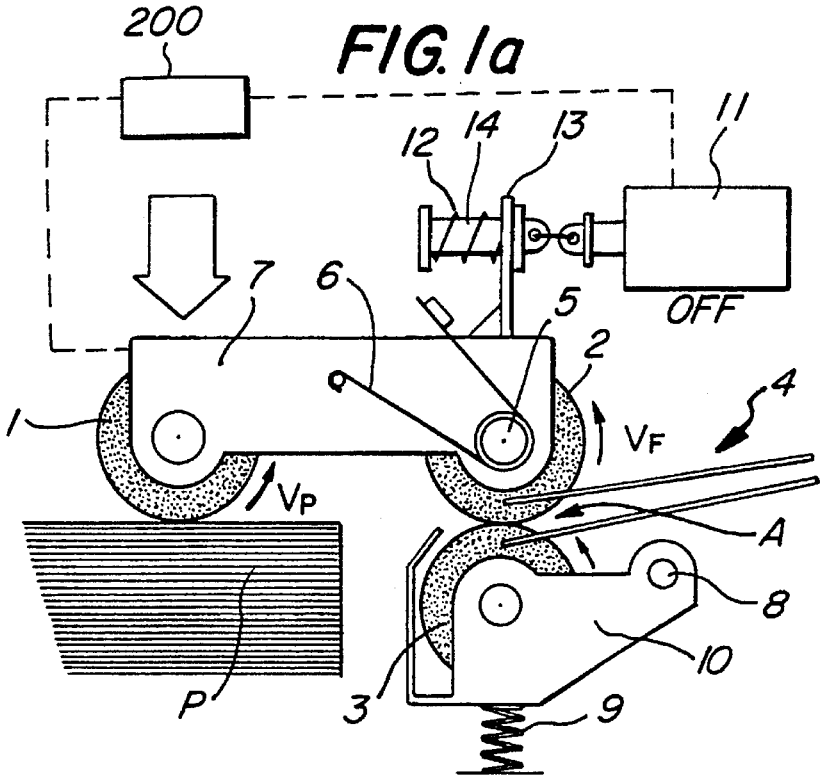
FIGS. 1*a* and 1*b* are illustrations briefly showing the construction of the feeding device and the paper feeding operation of a first embodiment of the present invention.
Figure 1B:
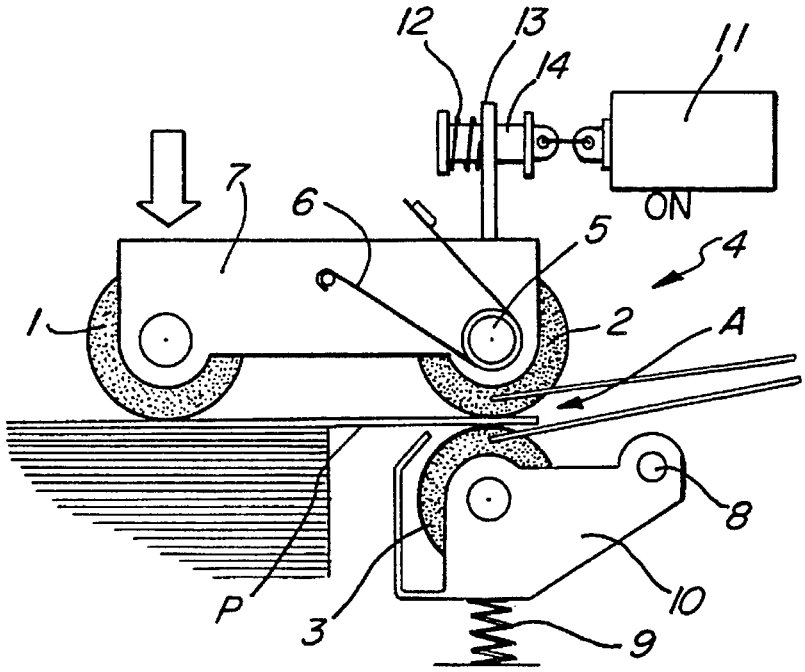

FIGS. 1*a* and 1*b* are illustrations briefly showing the construction of the feeding device of the first embodiment.

The feeding device of the first embodiment is provided with a pickup roller 1 which rotates in a state of pressure contact with the uppermost paper sheet P accommodated in a paper cassette or the like so as to feed said paper sheet P, and a handling section 4 disposed downstream from said pickup roller 1 in the sheet feeding direction. The handling section 4 comprises a forward rotation roller 2 that is rotatably driven in the sheet feeding direction, and a reverse rotation roller 3 disposed in pressure contact with said forward rotation roller 2 and which is rotatably driven in the opposite direction to the sheet feeding direction. Accordingly, when the pickup roller 1 feeds a plurality of sheets P, only the single uppermost sheet P is transported to the nip area A formed by the forward rotation roller 2 and the reverse rotation roller 3, whereas the second and any subsequent sheets P are returned by the reverse rotation roller 3. The pickup roller 1, forward rotation roller 2, and reverse rotation roller 3 are driven by a drive source such as motors or the like not shown in the illustrations. The sheet feeding speed of the forward rotation roller 2 is set so as to be greater than the sheet feeding speed of the pickup roller 1.

The pickup roller 1 and the forward rotation roller 2 are integratedly supported by the holder 7. The holder 7 applies a force via the spring 6 wound around the shaft 5 of the forward rotation roller 2 so as to press the pickup roller 1 against the paper sheet P. An elevated section 13 is provided at the top of the holder 7, and a shaft 14 is inserted through said elevated section 13. One end of the shaft 14 is connected to a solenoid 11, and a spring 12 is arranged between the other end of the shaft 14 and the elevated section 13. When the solenoid 11 is switched ON by switching or controlling means 200, the shaft 14 is moved toward the solenoid 11. The spring 12 is compressed via the movement of the shaft toward the solenoid 11. The elevated section 13 is forced rightwardly in the drawing via the aforesaid compression of the spring 12, such that the holder 7 is forced in a clockwise direction about the shaft 5 of the forward rotation roller. On the other hand, the holder 7 is forced so as to cause the pickup roller 1 to press against the paper sheet P via the spring 6 wound around the shaft 5 of the forward rotation roller. The force applied by the spring 6 is set so as to be greater than the force applied by the spring 12. The pickup roller 1, which is pressed against the paper sheet P via the aforesaid force of the spring 6, is acted upon by the force of the spring 12 which weakens the pressure contact with the paper sheet P. The reverse rotation roller 3 is supported by a holder 10, and the holder 10 is rotatable about the support shaft 8. A spring 9 is provided at the bottom of the holder 10 to apply a force on the forward rotation roller 2.

Figure 2:
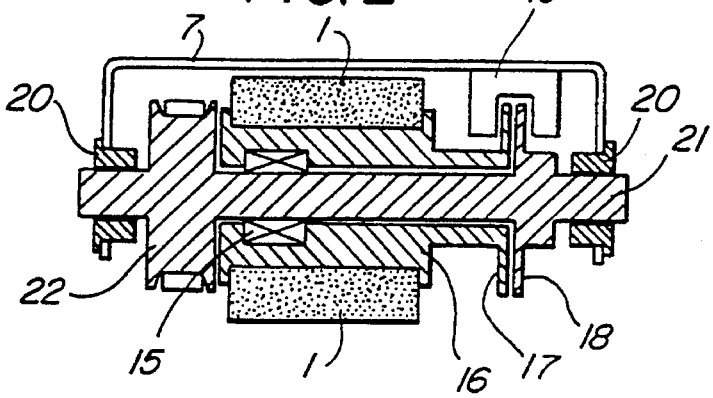
FIG. 2 is a section view of the pickup roller of the first embodiment.
Figure 3:
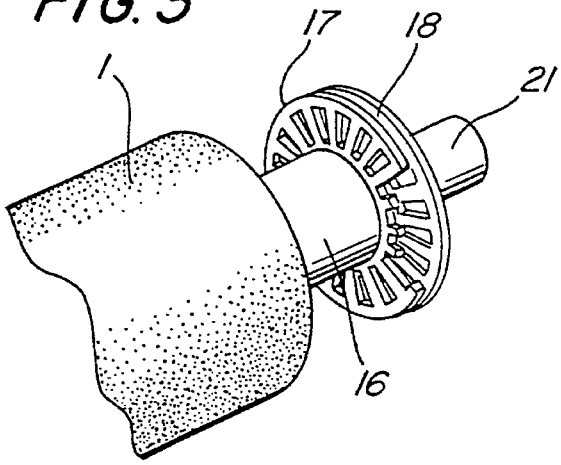
FIG. 3 is an illustration showing the construction of the slit plate of the first embodiment.
Figure 4:
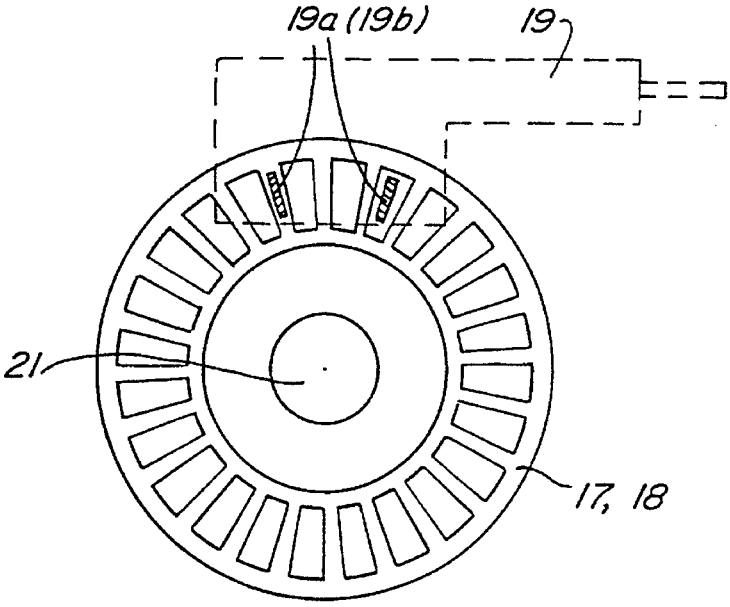
FIG. 4 is an illustration showing the construction of the slit plate and sensor of the first embodiment.

FIG. 2 is a section view in the axial direction showing the pickup roller 1 of the present embodiment. The pickup roller 1 is provided on the exterior surface of a metal core 16, which is connected to the drive shaft 21 via the clutch 15. Since the clutch 15 is a oneway clutch, the roller 1 idles in the sheet feeding direction. The drive shaft 21 is supported by a bearing 20 of the holder 7, and a belt pulley 22 is provided on the drive shaft 21.The belt pulley 22 receives the drive force from a drive section not shown in the drawings, and thereby rotatably drives the drive shaft 21. Slit plates 17 and 18 are respectively provided on the metal core 16 and drive shaft 21, as shown in FIGS. 3 and 4. A sensor 19 comprising photoemitter elements **19*a* and photoreceptor elements 19*b* is constructed such that the slit plates 17 and 18 are interposed between said elements. The light from the photoemitter elements 19*a* of the sensor 19 passes through the slit plates 17 and 18, and is received by the photoreceptor element 19*b*. The sensor 19 has photoemitter elements 19*a* and the photoreceptor elements 19*b* disposed oppositely, as shown in FIG. 4. This pair of elements comprising photoemitter elements 19*a* and photoreceptor elements 19*b* are positioned such that when the shielded portion of the slit plates 17 and 18 stop so as to be interposed between one pair of the photoemitter element 19*a* and photoreceptor element 19*b*, the light emitted by the photoemitter element 19*a* of the other pair can be received by the photoreceptor element 19*b* of said other pair. The sensor 19 is constructed such that any one pair of photoemitter element 19*a* and photoreceptor element 19*b* among the two pairs of said photoemitter elements 19*a* and photoreceptor elements 19*b*** can be used on a prioritized basis.

Figure 5:
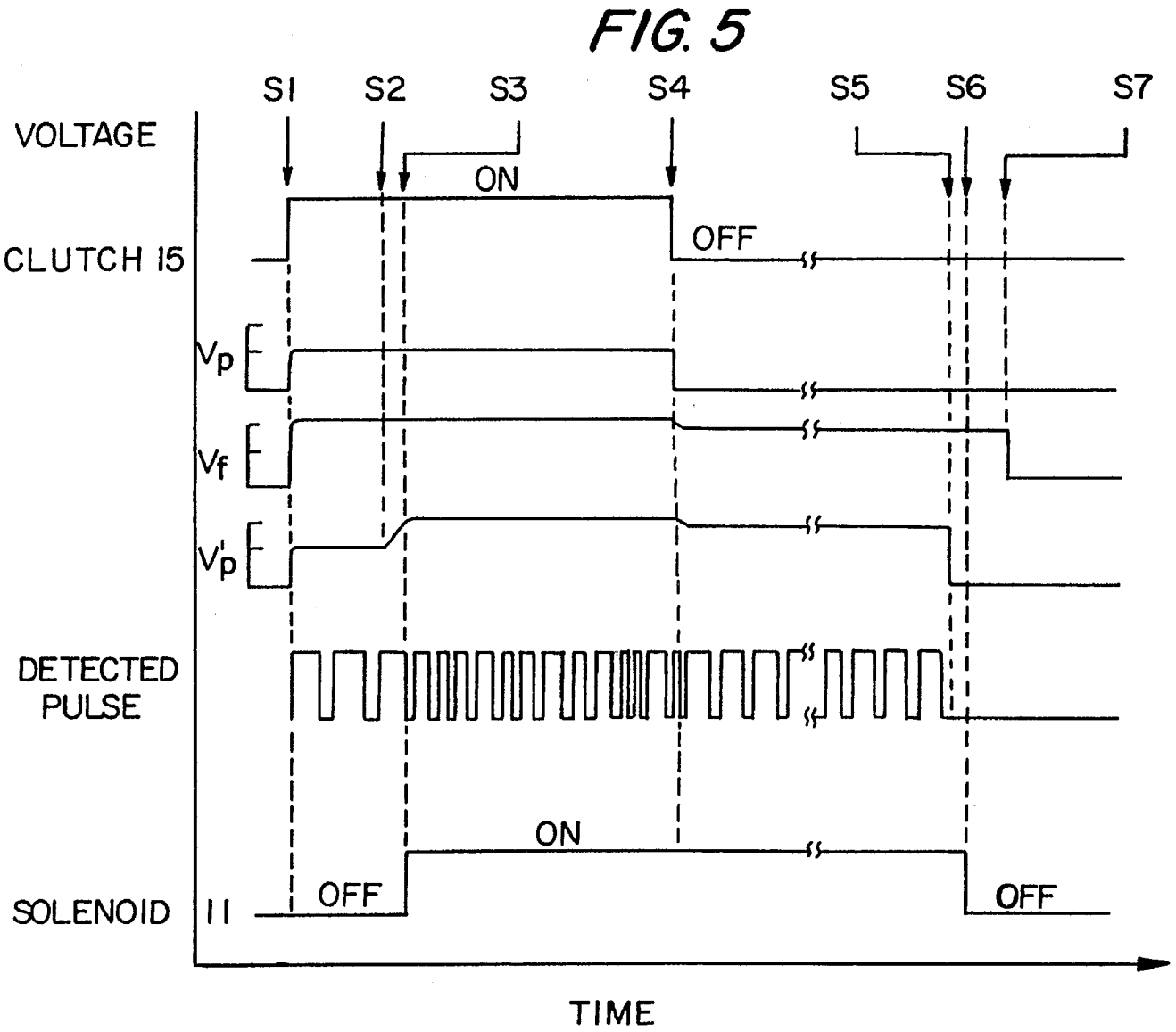
FIG. 5 is a timing chart of the feeding device of the first embodiment.

FIG. 5 is a timing chart for the feeding device of the present embodiment.

In FIG. 5, the rotational speed of the drive shaft 21 of the pickup roller 1, the rotational speed of the pickup roller 1, and the rotational speed of the forward rotation roller 2 are respectively designated as Vp, Vp', and Vf.

When a signal is received from the CPU of the copier or the like and the clutch 15 is switched ON, the pickup roller 1, forward rotation roller 2, and reverse rotation roller 3 are rotatably driven, and the sheet feeding operation starts (step S1). Since, at this moment, the pickup roller 1 is rotatably driven by the drive shaft 21, the rotational speed Vp' of the pickup roller 1 is equal to the rotational speed Vp of the drive shaft 21. There is no difference, therefore, in the rotational speeds of the slit plate 17 of the metal core 16 and the slit plate 18 of the drive shaft 21. Furthermore, the pulse signal generated by the photoreceptor element **19*b* of the sensor 19 is a uniform pulse which has a constant ON/OFF width. A first timer is started simultaneously with the switching ON of the clutch 15. When the leading edge of a paper sheet P is inserted into the nip area A (step S2), the sheet P is transported in accordance with the rotational speed Vf of the forward rotation roller 2. The pickup roller 1 is in a state of pressure contact with the aforesaid sheet P and, therefore, is rotated following the sheet P. Accordingly, a difference arises between the rotational speed Vp' of the pickup roller 1 and the rotational speed Vp of the drive shaft 21. This rotational speed differential causes a difference between the rotational speeds of the slit plate 17 of the metal core 16 and the slit plate 18 of the drive shaft 2, such that the pulse signal generated by the photoreceptor element 19*b* of the sensor 19 changes to a nonuniform pulse having nonuniform ON/OFF width. The solenoid 11 is switched ON (step S3) when this nonstandard pulse is generated by the photoreceptor element 19*b* of the sensor 19, and the pressure contact of the pickup roller 1 is weakened relative to the sheet P by means of said switching ON of the solenoid 11. By the weak pressure contact of the pickup roller 1 with the sheet P, the stability of the linear advance of the sheet P is maintained. The clutch 15 is switched OFF when a predetermined time has elapsed via the previously mentioned first timer (step S4). The drive force of the drive shaft 21 is stopped, and a second timer is started simultaneously with the switching OFF of the clutch 15. The rotational speed Vf of the forward rotation roller 2 is reduced by the load applied thereon by the pickup roller 1 when the clutch 15 is switched OFF. The rotation of the slit plate 18 is stopped when the drive force is stopped to the drive shaft 21. On the other hand, the slit plate 17 provided on the metal core 16 is rotated by the rotation of the pickup roller 1 driving the sheet P. Accordingly, the photoreceptor element 19*b* of the sensor 19 generates a uniform pulse via the slit plate 17. When the trailing edge of the sheet P passes by the pickup roller 1, the rotation of the pickup roller 1 is stopped (step S5). Since the rotation of the slit plate 17 is stopped simultaneously with the stopping of the rotation of the pickup roller 1, the receptor element 19*b* of the sensor 19 stops generating pulse signals, and the solenoid 11 is switched OFF (step S6) when the photoreceptor element 19*b* of the sensor 19 stops generating said pulse signals. The forward rotation roller 2 stops when a predetermined time has elapsed according to the previously mentioned second timer (step S7**).

In the present embodiment, during the previously described steps S3 and S4, slippage may occur between the forward rotation roller 2 and the paper sheet P inserted in the nip area A, said sheet P is transported by the pickup roller 1 rotatably driven by the drive shaft 21, such that the rotational speed differential between the slit plates 17 and 18 is eliminated, and the pulse signal moves from a nonuniform pulse to a uniform pulse. In this instance, the solenoid 11 may be switched ON/OFF in accordance with the state of the pulse signal generated by the photoreceptor element **19*b* of the sensor 19**.

Figure 6:
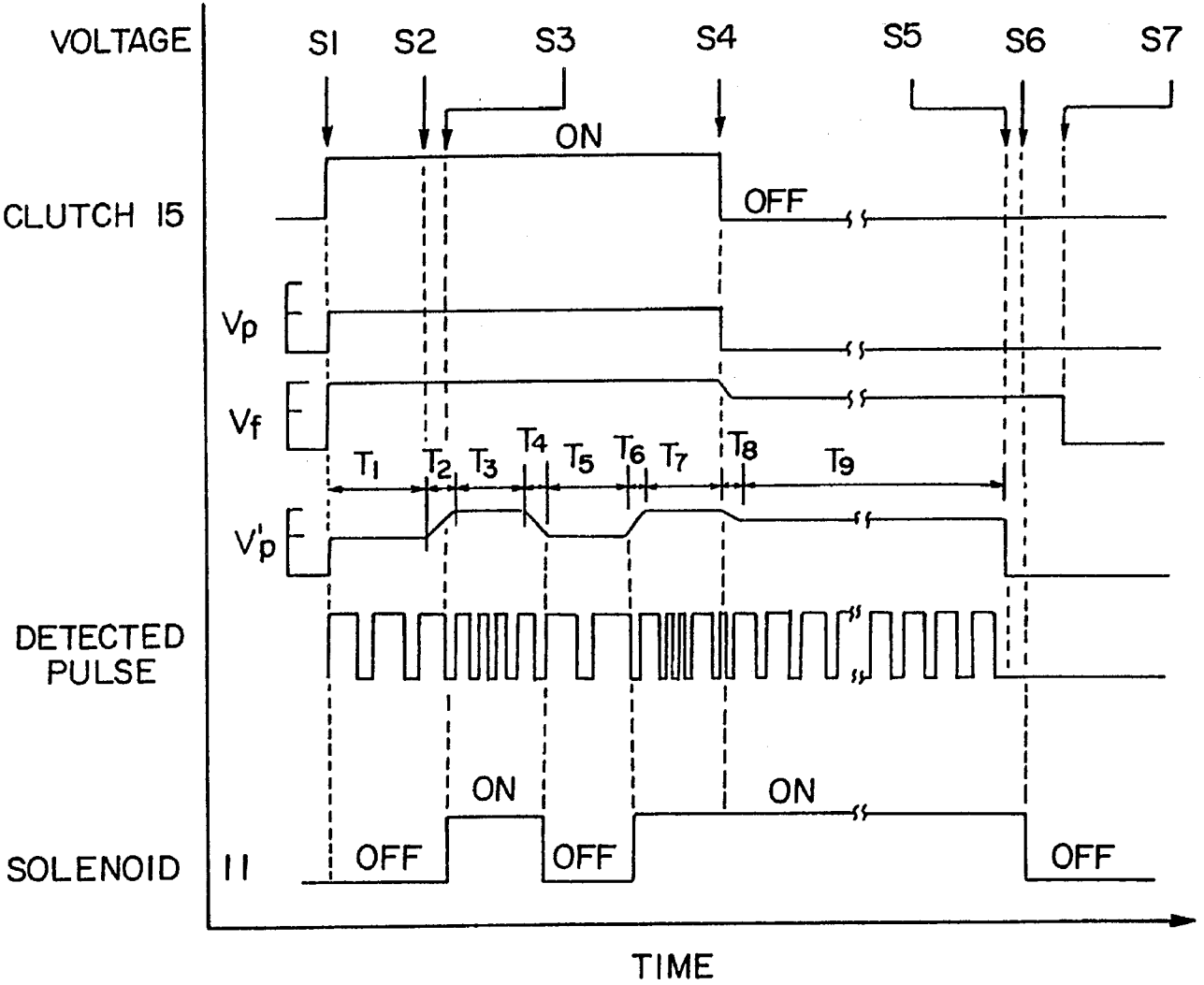
FIG. 6 is a timing chart of a second embodiment of the invention.
Figure 7:
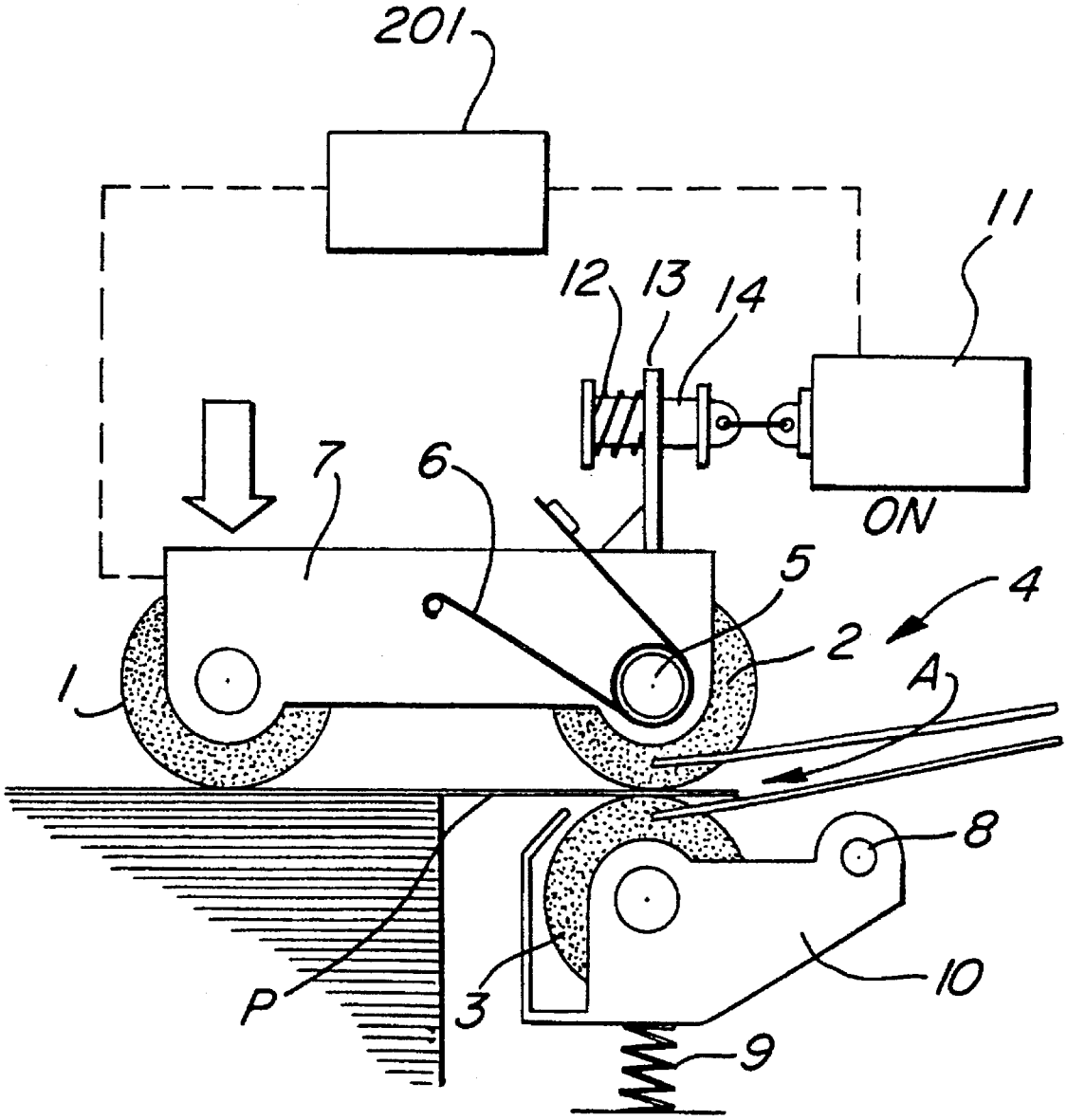
FIG. 7 is an illustration of a third embodiment of the present invention.

As shown in the timing chart of FIG. 6, when the pulse signal generated by the photoreceptor element **19*b* of the sensor 19 changes from a nonuniform pulse to a uniform pulse in steps S3 and S4 (time T3 to T5 in the drawing), the solenoid 11 is switched OFF, and the contact pressure of the pickup roller 1 on the sheet P is increased, so as to supplement the sheet transport force of the forward rotation roller 2. If the pulse signal generated by the photoreceptor element 19*b* of the sensor 19 changes from a uniform pulse to a nonuniform pulse after the solenoid 11 is switched OFF (time T5 to T7), the solenoid 11 is switched ON because the slippage of the sheet P relative to the forward rotation roller 2 has been eliminated, and the pressure contact force of the pickup roller 1** on the sheet P is reduced.

Although the present embodiment has been described in terms of switching OFF the clutch 15 and the forward rotation roller 2 by means of the elapse of predetermined times via the first and second timers, respectively, it is to be noted that a sensor may be provided to detect a sheet P downstream from the handling section 4 in the sheet transport direction. Such a sensor would detect the leading edge of a sheet P, whereupon the clutch 15 is switched OFF, and said sensor would detect the trailing edge of a sheet P, whereupon the rotation of the forward rotation roller 2 is stopped.

In the embodiment described above, pulse signals are generated by the photoreceptor element **19*b* of the sensor 19 based on the rotational speeds of the pickup roller 1 and drive shaft 21, and the solenoid 11 is switched ON when the generated pulse signal is nonuniform. It is to be noted, however, that a detector may be provided to detect the rotational speed of the pickup roller 1, such that the solenoid 11 is switched ON when said detector detects that the rotational speed of the pickup roller 1 is greater than the rotational speed of the drive shaft 21**.

Further, detectors may be provided to detect the rotational speed of the pickup roller 1 and that of the forward rotation roller 2 separately, such that the solenoid 11 is switched ON by switching or controlling means 201 when the rotational speed of the pickup roller 1 becomes the same as that of the forward rotation roller 2.

Although a reverse rotation roller 3 is used in the above-described embodiment, it is to be understood that said reverse rotation roller need not be rotated. Alternatively, a stationary pad may be used instead of the aforesaid reverse rotation roller 3.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A feeding device comprising:

a feed roller which applies a pressure contact force to a sheet of paper and feeds the paper;

a drive shaft for driving said feed roller;

a transporting roller disposed downstream from said feed roller relative to a paper feeding direction for transporting the paper fed by said feed roller, wherein a speed at which the paper is transported by said transporting roller is faster than a speed at which the paper is initially fed by said feed roller;

a oneway clutch disposed between said drive shaft and said feed roller so as to allow said feed roller to rotate by a force of transportation of the paper when transported by said transporting roller; and switching means for reducing the pressure contact force of said feed roller relative to the paper when said feed roller is rotated by the force of rotation of the paper transported by said transporting roller.

2. The feeding device as claimed in claim 1, further including a second roller which makes pressure contact with said transporting roller and is rotatably driven in a direction opposite to the paper feeding direction for separating an uppermost paper from any erroneously fed paper so as to transport only the uppermost paper.

3. A feeding device comprising:

a feed roller which applies a pressure contact force to a sheet of paper and feeds the paper;

a drive shaft for driving said feed roller by rotation thereof;

a paper transporting roller disposed downstream from said feed roller and rotatably driven in a paper feeding direction for transporting the paper fed by said feed roller, the paper transporting roller transporting the fed paper at a speed faster than a speed at which said feed roller feeds the paper;

a oneway clutch disposed between said drive shaft and said feed roller so as to permit free rotation of said feed roller in a paper feeding direction; and switching means for reducing the pressure contact force of said feed roller relative to the paper when a rotational speed of said feed roller becomes faster than a rotational speed of said drive shaft.

4. The feeding device as claimed in claim 3 further comprising detecting means for detecting whether the rotational speed of said feed roller is faster than a rotational speed of said drive shaft.

5. The feeding device as claimed in claim wherein said detecting means includes a pair of light emitting element and light receiving elements, a first slit plate provided on said drive shaft and a second slit plate provided on said feed roller, the first and second slit plates being disposed between the pair of light emitting elements and light receiving elements.

6. The feeding device as claimed in claim 3 further comprising a separating roller which makes pressure contact with said transporting roller and is rotatably driven in a direction opposite to the paper feeding direction for separating an uppermost paper from erroneously fed paper so as to transport only the uppermost paper.

7. A feeding device comprising:

a feed roller for feeding a sheet from a stack of sheets at a predetermined rotational speed;

a pressure means for pressing said feed roller on a top of the stack of sheets;

a transporting roller for transporting the sheet fed by the feed roller, a rotational speed of said transport roller being faster than a rotational speed of said feed roller;

a detector for detecting a speed of rotation of said feed roller; and a controlling means for disabling said pressure means when said detector detects that a rotational speed of the feed roller becomes faster than its initial predetermined rotational speed.

8. The feeding device as claimed in claim 7, wherein said controlling means disables said pressure means when the sheet is transported at a speed of rotation of said transporting roller.

9. A feeding device comprising:

a feed roller which applies a pressure contact force to a paper and feeds the paper;

a transporting roller for transporting the sheet fed by the feed roller, a rotational speed of said transport roller being faster than a rotational speed of said feed roller;

a first detector for detecting a rotational speed of said feed roller;

a second detector for detecting a rotational speed of said transporting roller; and a switching means for reducing the pressure contact force of said feed roller relative to the paper when the rotational speed detected by said first detector and the rotational speed detected by said second detector become the same.

* * * * *